United States Patent [19]

Hafner

[11] Patent Number: 4,561,617

[45] Date of Patent: Dec. 31, 1985

[54] SUPPORT DEVICE FOR DISPLAYING OBJECTS

[76] Inventor: William E. Hafner,
7227 Oakland Ave. S.
Richfield, Minn. 55423

[21] Appl. No.: 628,497

[22] Filed: Jul. 6, 1984

[51] Int. Cl.[4] ..... F16L 3/00

[52] U.S. Cl. ..... 248/121; 248/225.2; 248/489

[58] Field of Search ..... 248/121, 200.1, 218.4, 248/221.3, 225.1, 224.4, 224.3, 73, 107, 230, 231, 489, 215, 65, 497, 225.2; 211/41

[56] References Cited

U.S. PATENT DOCUMENTS

| | | | |
|---|---|---|---|
| D. 189,241 | 11/1960 | Morrill | D17/2 |
| 897,969 | 9/1908 | Faris . | |
| 1,045,481 | 11/1912 | Walther | 248/230 X |
| 1,361,056 | 12/1920 | Hickman | 248/215 |
| 1,372,205 | 3/1921 | Smith | 248/224.3 X |
| 1,382,908 | 6/1921 | Helka . | |
| 1,787,734 | 1/1931 | Rowling | 248/73 |
| 1,791,019 | 2/1931 | Wilson | 248/230 X |
| 2,488,147 | 11/1949 | Theisen | 248/30 |
| 2,714,496 | 8/1955 | Doyle | 248/65 X |
| 2,724,568 | 11/1955 | Rabinovitch | 248/29 |
| 2,792,612 | 5/1957 | Wickliffe | 24/259 |
| 2,831,339 | 4/1958 | Jones | 248/65 X |
| 2,899,154 | 8/1959 | Zavolner | 248/30 |
| 2,903,227 | 9/1959 | DeKalb Key | 248/356 |
| 2,967,592 | 1/1961 | Stein | 189/26 |
| 3,081,972 | 3/1963 | Gray, Jr. | 248/33 |
| 3,161,263 | 12/1964 | Stokes | 248/224.4 X |
| 3,291,434 | 12/1966 | Whitechester | 248/356 |
| 3,319,391 | 5/1967 | Lutch | 248/231 X |
| 3,414,219 | 12/1968 | Siegel | 248/65 |
| 3,519,293 | 7/1970 | Henning et al. | 248/200.1 X |
| 3,633,865 | 1/1972 | Hogg | 248/467 |
| 3,685,663 | 8/1972 | Hoeffleur | 248/231 X |
| 3,797,799 | 3/1974 | Maggia | 248/491 |
| 3,847,332 | 11/1974 | Murai | 248/224.3 X |
| 3,961,822 | 6/1976 | Daniel | 248/200.1 X |
| 4,101,036 | 7/1978 | Craig | 211/86 |

OTHER PUBLICATIONS

New England Frameworks Catalog (three pages), final date Jul. 15, 1984.

Touch of Class Catalog, p. 26, Summer 1984.

*Primary Examiner*—Ramon S. Britts
*Assistant Examiner*—David M. Purol
*Attorney, Agent, or Firm*—Kinney & Lange

[57] ABSTRACT

A support device for displaying objects such as plates or framed pictures includes a mounting bracket attached to a support pole and a spring wire member for attaching the object to be displayed to the mounting bracket. The bracket includes a pole-engaging member with an inner surface generally conforming to the contour of the pole. The inner surface frictionally engages at least a portion of the outer surface of the pole. The pole-engaging member has a pair of legs, each with an outwardly extending tab portion. A connecting member engages the legs of the pole-engaging member proximate the tab portions with first and second slots securing the bracket in frictional engagement with the support pole. The connecting member also has at least one hook eyelet extending outwardly therefrom with an opening for accepting a portion of the spring wire member. The spring wire member has a pair of outwardly extending arms for attachment to the object to be displayed.

18 Claims, 10 Drawing Figures

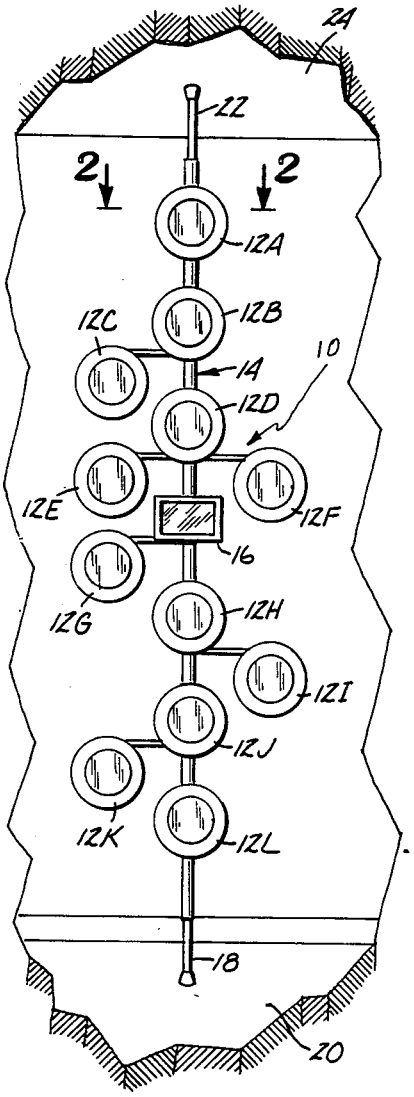
Fig.1
Fig.2
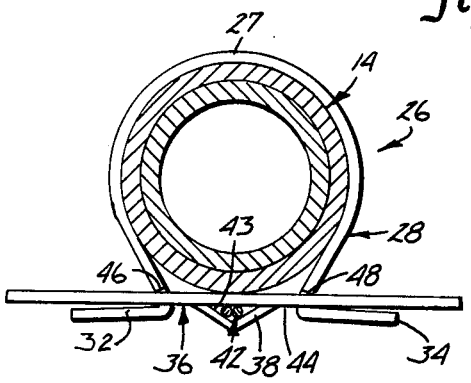
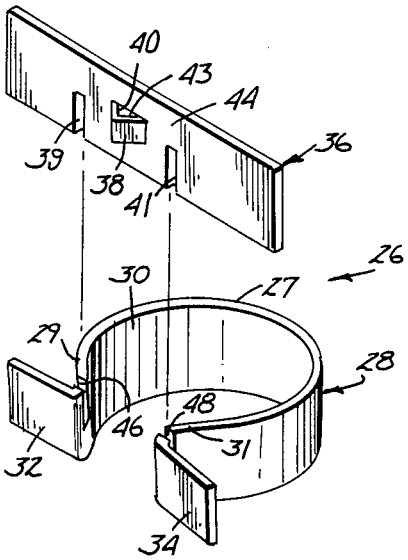
Fig.3

Fig.4
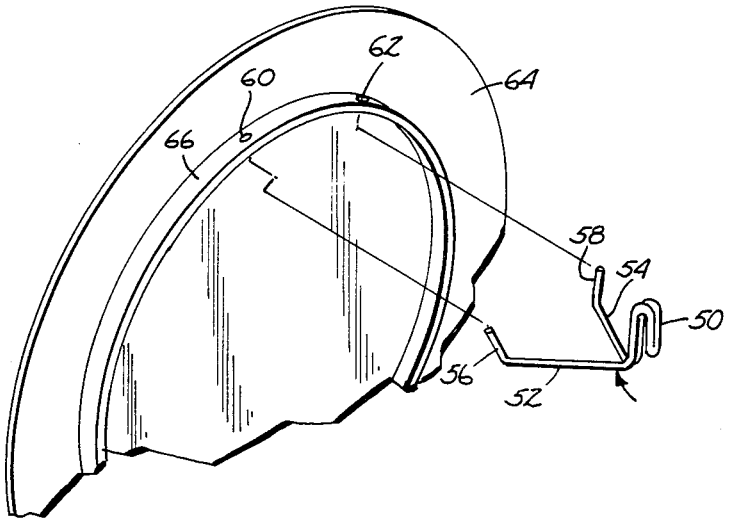
Fig.5
Fig.6
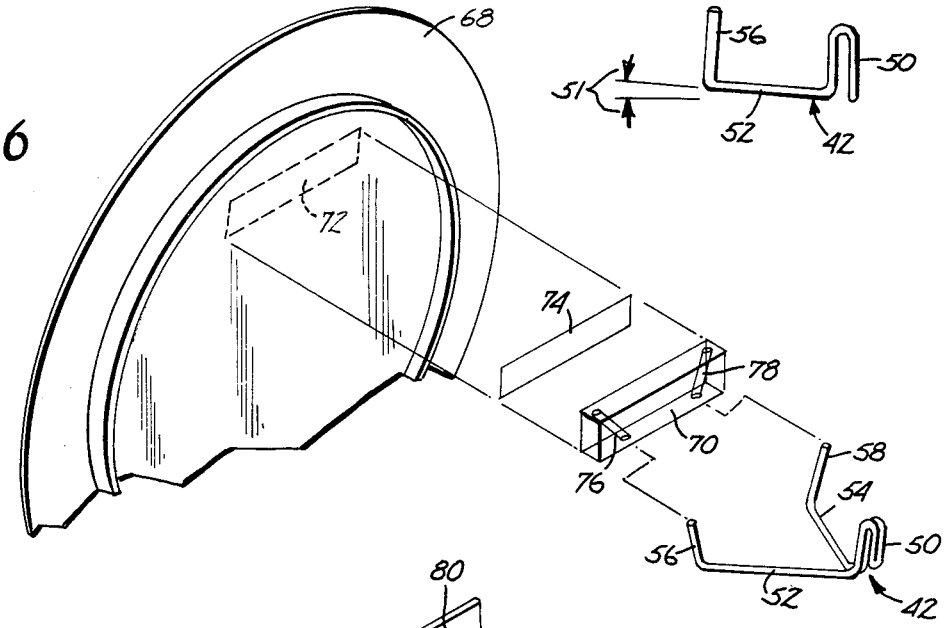
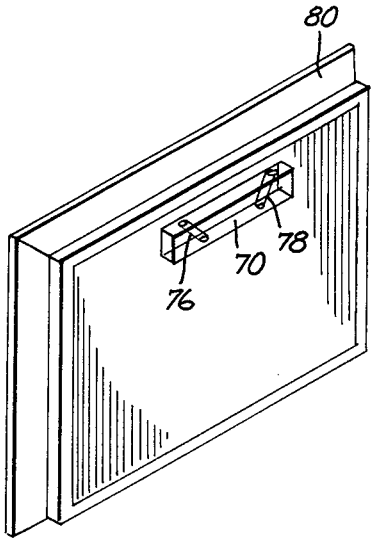
Fig.7

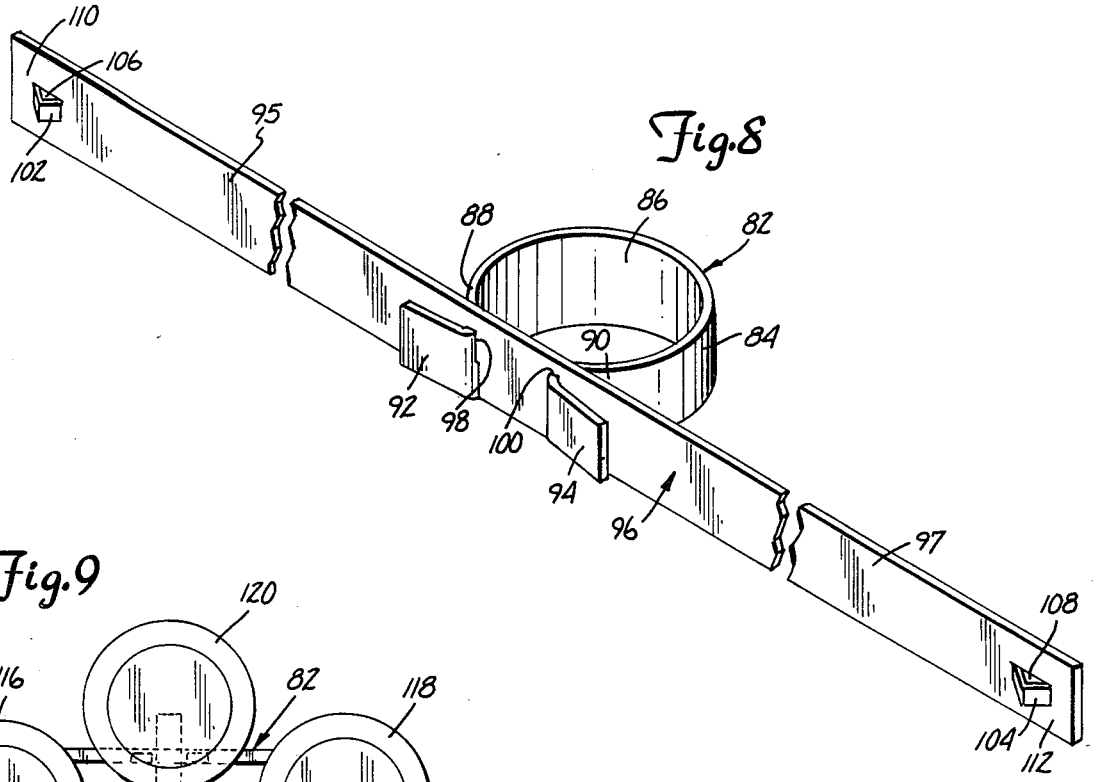
Fig.8
Fig.9
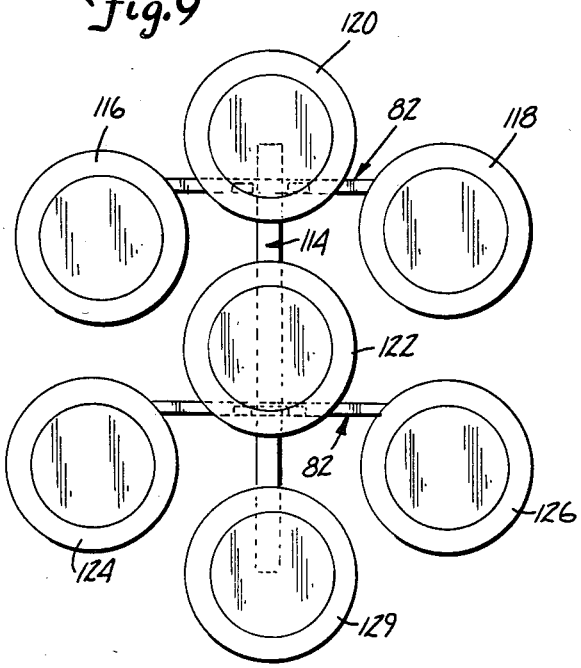
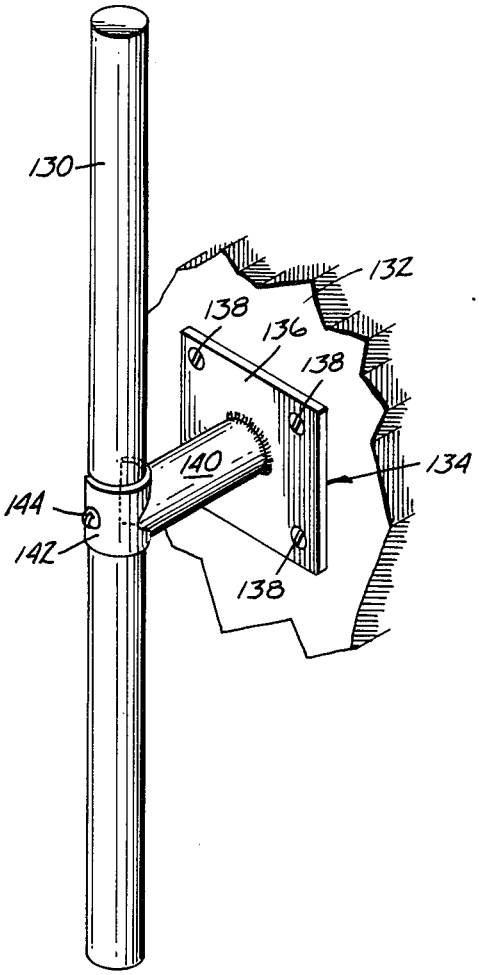
Fig.10

SUPPORT DEVICE FOR DISPLAYING OBJECTS

BACKGROUND OF THE INVENTION

1. Field of the Invention

The present invention relates to support devices using a pole for a support member, and in particular, it relates to support devices that securely hold objects, such as plates and frames.

2. Description of the Prior Art

The hanging or displaying of decorative plates in the home, especially collectible type plates, has been quite popular. In recent years, interest in collectible plates has grown dramatically. Collectible plates are issued in series of annual issues and in many instances are displayed in lieu of paintings. In an issue of plates that is on an annual basis or in a series, typically the number of plates is quite large. For the entire series or issue to be displayed, a great amount of space is needed. Standard shelving and cabinets, such as are typically found in the home, are an expensive method of displaying plates.

One method used in the past to display plates was to hang the plates on the wall using nails. Oftentimes, the size of the nail that was used was the type that was found around the home. This practice resulted in nails either being undersized, jeopardizing safety of the plate, or oversized, creating sizable holes and cracking plaster and perforating wall paper. Placing nails in plasterboard-type walls runs the additional risk that over a period of time the hole made by the nail becomes larger, resulting in a decrease in the holding power of the nail.

Another method used to display plates or framed objects includes the use of water-activated adhesive hangers, an example of which is shown in the Hogg U.S. Pat. No. 3,633,865 and in the Rabinovitch U.S. Pat. No. 2,724,568. Water is applied to the adhesive, which holds the hanger to the wall. One drawback of adhesive wall hangers are that the user may apply too little or too much water, which results in only a temporary bond being made between the hanger and the wall. Adhesive hangers also carry cautionary warnings that the hanger should not be used in very dry or humid areas and that the hangers should not be used to hang ceramics or items of great value. In addition, removing the adhesive hangers from the wall oftentimes results in damage to the wall since plaster and paint are removed, clinging to the adhesive.

Still another method of hanging plates on walls includes the use of self-sticking wall hangers or hooks. Typically, the manufacturers of self-sticking wall hangers suggest that objects hung with these wall hangers are not to be hung over TV sets, beds and/or expensive furniture.

There are also commercially-available frames, similar to picture frames, in which plates are inserted and the frame is hung on the wall. However, the use of these frames to display plates is expensive on a per-plate basis.

Other types of plate holders are illustrated in the Zavolner U.S. Pat. No. 2,899,154 and the Theisen U.S. Pat. No. 2,488,147 and the Maggia U.S. Pat. No. 3,797,799. However, none of these plate holders address the problem of displaying plates in an efficient and economical manner.

The Helka U.S. Pat. No. 1,382,908 and the Faris U.S. Pat. No. 897,969 illustrate picture hangers. However, these hangers also do not provide a method of economically displaying plates or pictures.

The DeKalb Key U.S. Pat. No. 2,903,227, the Stein U.S. Pat. No. 2,967,592, the Gray, Jr. U.S. Pat. No. 3,081,972, the Whitechester U.S. Pat. No. 3,291,434, and the Craig U.S. Pat. No. 4,101,036 describe structures for supporting or displaying objects that use an upright standing pole. However, none of these patents illustrate a device suitable for economically displaying plates.

SUMMARY OF THE INVENTION

The present invention includes a support device for displaying objects, such as plates or framed pictures. The support device includes a mounting bracket frictionally attachable to a support pole and a spring wire member for attaching the object to be displayed to the mounting bracket. The mounting bracket includes a pole-engaging member having an inner surface generally conforming to the contour of the pole and frictionally engaging at least a portion of an outer surface of the pole. The pole-engaging member has a pair of legs, with each leg having an outwardly extending tab portion. A connecting member engages the legs of the pole-engaging member proximate the tab portions with first and second slots, securing the bracket in frictional engagement with the support pole. The connecting member also has at least one portion extending outwardly therefrom with an opening for accepting a portion of the spring wire member. The spring wire member has a pair of outwardly extending arms for attachment to the object to be displayed.

BRIEF DESCRIPTION OF THE DRAWINGS

FIG. 1 is a front view of a support fixture of the present invention supporting a plurality of plates and a framed picture.

FIG. 2 is a cross-sectional view of the mounting bracket taken along the line 2—2 in FIG. 1.

FIG. 3 is an exploded perspective view of the mounting bracket of FIG. 2.

FIG. 4 is a perspective view showing the manner in which a spring wire member of the present invention is attached to a plate.

FIG. 5 is a side view of the spring wire member of the present invention.

FIG. 6 is an exploded perspective view illustrating an alternative method of attaching the spring wire member to a plate.

FIG. 7 is a perspective view of the backside of a framed picture having a block member for attaching the spring wire member of the present invention to the framed picture.

FIG. 8 is a perspective view of an alternative embodiment of the mounting bracket of the present invention.

FIG. 9 is a front view illustrating an alternative arrangement of plates using the support fixture of the present invention.

FIG. 10 is a perspective view showing an alternative means for supporting the pole of the present invention.

DETAILED DESCRIPTION OF THE PREFERRED EMBODIMENTS

The support device of the present invention is generally indicated at 10 in FIG. 1. The support device 10 is used to display a plurality of plates indicated by reference characters 12A through 12L on a support pole 14. The plates 12A through 12L are arrangable on the support pole in a manner that uses space efficiently, or in any arrangement desired by the user. In addition, framed picture 16 can be displayed along with the plates, or in association with other pictures, instead of the plates as shown in the same efficient manner.

The support pole 14 is preferably a standard extension pole that includes a lower ground-engaging portion 18 for engaging the floor and an upper ceiling-engaging portion 22 for engaging a ceiling 24 with at least one of the portions 18 or 24 being biased to hold the support pole in a fixed position. The extension pole 14 allows the support fixture of the present invention to be placed anywhere in a room without permanent attachment or damage to the floor, ceiling or walls.

In FIG. 2, a mounting bracket 26 is illustrated in frictional engagement with the extension pole 14. The mounting bracket 26 is used to display plates 12A, 12B, 12D, 12H, 12J, 12L and framed picture 16 in FIG. 1. The mounting bracket 26 includes a pole-engaging member 28 having an inner surface 30 with preferably a semi-cylindrical back portion 27, as illustrated in FIG. 3, that generally conforms to the contour of an outer cylindrical surface of the extension pole 14. Preferably, at least one-half of the inner surface 30 conforms to the surface of the pole. The member 28 includes a pair of legs 29 and 31 with outwardly extending tab portions 32 and 34, respectively. The tab portions 32 and 34 extend outwardly in opposite directions on the same side of the extension pole.

A longitudinal plate connecting member 36 includes a pair of spaced-apart slots 39 and 41 which are positioned to engage the member 28 proximate the tab portions 32 and 34. The connecting member 36 slightly brings the legs together, placing the inner surface 30 in sufficient frictional engagement with the cylindrical surface of the extension pole 14 so that when a plate or similar object is hung from the mounting bracket 26, the mounting bracket 26 securely holds the position that it was placed in on the pole 14. It will be appreciated that the mounting bracket 26 can be positioned anywhere along the length of the extension pole 14 without the need of any additional fasteners, adhesives or the like.

The connecting member 36 further includes a hook eyelet 38 forming an opening or receptacle 40 on a side of the connecting member 36 opposite from the extension pole 14 and preferably positioned between the slots 39 and 41. A spring wire member 42 (discussed subsequently) engages an inner surface 43 of the hook eyelet 38 and an outwardly-facing surface 44 of the connecting member 36, as best illustrated in FIG. 2.

The member 28 preferably has first and second slots 46 and 48, as best illustrated in FIG. 3, for cooperation with the slots 39 and 41 respectively, of the connecting member 36. The slots 46 and 48 are positioned in the legs 29 and 31 proximate the tab portions 32 and 34, all respectively.

The pole-engaging member 28 and the connecting member 36 are preferably made of metal, such as aluminum. However, any suitable material capable of frictionally engaging the pole and having sufficient rigidity to support a plate or similar object from the extension pole is within the scope of the invention.

The spring wire member 42 is preferably of a unitary construction made from a single section of spring wire having a rearward hook portion 50 for insertion into the opening 40 of the connecting member 36, as best illustrated in FIGS. 4–6. The spring wire member 42 is formed by initially bending the section of wire in half, then bending a rearward portion of the wire downwardly to form the hook portion 50. A pair of spread-apart arm portions 52 and 54 are formed by bending a distal portion of the doubled wire so that the arm portions are disposed in a slightly upward inclined direction from an axis perpendicular to the rear portion 50, as indicated by the arrows 51 and are disposed in a diverging angular relationship. Each arm portion 52 and 54 has a bent finger portion 56, 58, respectively, disposed in a generally upward direction when attached to the mounting bracket.

A decorative plate 64 having spaced-apart apertures 60 and 62 in an annular shoulder 66 is illustrated in FIG. 4. The finger portions 56 and 58 are inserted into the apertures 60 and 62, respectively. Preferably, the finger portions 56 and 58 of the spring wire member 42 are spaced apart a lesser distance than the apertures 60 and 62 of the plate so that when the finger portions 56 and 58 are inserted into the apertures 60 and 62, the finger portions 56 and 58 push against the apertures 60 and 62 thereby gripping the plate. The weight of the plate 64 pushes the arm portions 52 and 54 slightly downwardly when the plate is attached to the spring wire member 42. The arm portions 52 and 54, however, are sufficiently resilient to hold the plate in a suitable display position.

An alternative embodiment of attaching a plate 68 having no apertures to the spring wire member 42 is illustrated in FIG. 6. A mounting block 70 is adhesively attached to a position 72, indicated in broken lines, using an adhesive system, such as a strip 74 of double-backed adhesive tape. The mounting block 70 has a pair of spaced-apart bores 76 and 78 for the same purpose as apertures 60 and 62 of plate 64 in FIG. 5. The end portions 56 and 58 of the spring wire member are inserted into the bores 76 and 78 after the mounting block 70 has been adhesively attached to the back of the plate 68. Preferably, the bores 76 and 78 are disposed in diverging angular directions and are substantially parallel to the plane of the mounting block 70. The mounting block 70 is also used to mount a framed picture 80, as illustrated in FIG. 7. The mounting block 70 is similarly mounted with a strip of double-backed adhesive tape (not shown) in FIG. 8.

An alternative embodiment of the mounting bracket 82 is illustrated in FIG. 8. The mounting bracket 82 includes a pole-engaging member 84 similar to the member 28 illustrated in FIGS. 2 and 3. The pole-engaging member includes an inner surface 86 conforming substantially to the outer surface of the pole for frictional engagement thereof. The member 84 includes a pair of legs 88 and 90 with a pair of spaced-apart tab portions 92 and 94 extending in opposite directions. A connecting member 96 having first and second longitudinal arm sections 95 and 97 with first and second slots 98 and 100, respectively. The slots 98 and 100 engage the legs 88 and 90 proximate the tab portions 92 and 94, respectively. The first and second arm sections have spaced-apart hook eyelets 102 and 104 having openings 106 and 108 on opposite end portions 110 and 112, respectively.

The connecting member 96 is longer than the connecting member illustrated in FIGS. 2 and 3 and is sufficiently long (with the hook eyelets 102 and 104 sufficiently spaced apart) so that two individual plates can be mounted on the mounting bracket 82 using separate spring wire members (not shown), similar to the spring wire member 42 illustrated in FIGS. 4–6. An example of the mounting bracket 82 mounted to a pole 114 is illustrated in FIG. 9. Plates 116 and 118 are mounted sufficiently far apart so that plates 120 and 122, using the mounting bracket 26, can be mounted from the pole. Similarly, directly below plates 116 and 118, plates 124 and 126 are mounted onto the pole 114 with the mounting bracket 82 sufficiently far apart so that the plate 122 and the plate 128 can be mounted onto the pole with the mounting bracket 26 (not shown) in a space efficient manner. The arrangement illustrated in FIG. 9 teaches an efficient use of space for the display of plates in an alternative arrangement using the present invention.

Another alternative embodiment of the mounting bracket is illustrated in FIG. 1, displaying plates 12C, 12G, 12I, and 12K. Although this alternative embodiment of the mounting bracket is not illustrated in detail, it is quite similar to the mounting bracket 82 illustrated in FIG. 8. The only difference is that the connecting member has only one arm section with only one hook eyelet for mounting one spring wire member.

In addition, the mounting brackets 26 and 82 can be used to display plates from a horizontally disposed support pole, such as an extension from a vertical support pole (not shown). The hook eyelets 38 in the mounting bracket 26, and 102 and 104 in the mounting bracket 82 are simply oriented 90° from that shown in the Figures so that the respective openings are disposed in a substantially vertical direction in order to insert the spring wire members therein for displaying plates. As is understood from the above, many variations with regard to the manner the hook eyelets are positioned on the connecting member of the mounting bracket are possible without departing from the spirit and scope of the present invention.

The mounting bracket of the present invention can also be used on poles other than extension poles. As illustrated in FIG. 10, a pole 130 is fixedly attached to a wall 132 by a wall mounting bracket 134. The bracket 134 has a base plate 136 that is attached to the wall 132 by a plurality of screws 138. An extension arm 140 is disposed substantially perpendicularly to the base plate 136 and to the wall 132 and is fixedly attached at a distal end to the pole 130 by a clamping member 142. The clamping member 142 is secured to the pole 130 by a screw 144. The mounting bracket 134 can be used to securely mount the pole 130 in a substantially vertical position as illustrated in FIG. 10. In addition, the pole 130 can be disposed in a substantially horizontal position or any other position thereinbetween (not illustrated) by simply rotating the bracket 134.

In summary, the support fixture of the present invention is used to display decorative plates or like objects in a space efficient manner on a support pole. The mounting brackets can be moved anywhere on the support pole without any additional fasteners or adhesives, due to the frictional engagement of the support pole with the mounting bracket. A great number of plates of a series or of an issue are displayable together in an economical manner.

Although the present invention has been described with reference to preferred embodiments, workers skilled in the art will recognize that changes may be made in form and detail without departing from the spirit and scope of the invention.

What is claimed is:

1. A support device for displaying an object from a support pole having an outer wall surface and means for securely holding the support pole in a fixed position, the object to be displayed having spaced apart first and second apertures, the device comprising:

a support pole-engaging member having a pole-engaging section with an inner surface such that the inner surface conforms to the outer wall surface of the support pole is adapted to and frictionally engage at least a portion of the outer wall surface and further having first and second leg portions with each leg portion having an outwardly extending tab portion;

a connecting member having first and second slots for insertably engaging the first and second leg portions, respectively, proximate the tab portions to secure the support pole-engaging member in frictional engagement with the support pole, and having means for attaching the object to be displayed; and a first wire member having a hook portion attachably engaging the means for attaching and having first and second outwardly extending diverging arm portions for attachment to the object wherein the wire member is made from spring-type wire and wherein the first and second outwardly extending arm portions of the wire member extend in an angular upward direction and the first and second spaced apart apertures are adapted for receiving distal end portions of the wire member.

2. The device of claim 1 wherein the means for attaching is an integrally formed outwardly extending hook eyelet having an opening.

3. The device of claim 2 wherein the hook eyelet is positioned between the first and second slots.

4. The device of claim 1 wherein the connecting member has first and second outwardly extending arm sections and the means for attaching includes first and second spaced apart integrally formed hook eyelets and having a second wire member, each hook eyelet having an opening for receiving the hook portion of the first and second wire members, respectively.

5. The device of claim 1 wherein the object is a plate having a pair of spaced-apart apertures and the first and second outwardly extending arm portions of the wire member include first and second substantially vertically disposed finger portions at their outer ends, respectively, for insertion into the first and second apertures in the plate, all respectively.

6. The device of claim 1 wherein the object to be displayed has an attaching block and means for adhesively attaching the attaching block to the object to be displayed, and wherein the first and second apertures are disposed in the attaching block for receiving the distal end portions of the wire member.

7. The device of claim 1 wherein the support pole-engaging member includes first and second slots positioned in the first and second legs, respectively, proximate the tab portions for cooperation with the first and second slots of the connecting member.

8. A display device for displaying an object having first and second apertures, the device comprising:

a support pole having means for securely holding the support pole in a fixed position and having an outer wall surface;

a support pole-engaging member having a pole-engaging section with an inner surface substantially conforming to at least a portion of the outer wall surface of the support pole and frictionally engaging said portion of the outer wall surface and further having first and second leg portions with each leg portion having an outwardly extending tab portion;

a connecting member having first and second slots for insertably engaging the first and second leg portions, respectively, proximate the tab portions securing the support pole-engaging member in frictional engagement with the support pole, and having means for attaching the object to be displayed; and a wire member having a hook portion in detachable engagement with the means for attaching and first and second outwardly extending diverging arm portions for attachment to the object wherein the wire member is made from spring-type wire and wherein the first and second outwardly extending arm portions of the wire member extend in an angular upward direction and the first and second spaced apart apertures are adapted for receiving distal end portions of the wire member.

9. The device of claim 8 wherein the support pole is an extension pole and the means for securely holding the support pole in a fixed position are upper and lower ceiling and floor engaging end portions with at least one of the end portions being biased.

10. The device of claim 8 wherein the means for securely holding the support pole in a fixed position includes a substantially horizontally disposed extension arm attached at one end to the support pole and at another having means for securing to a wall.

11. The device of claim 8 wherein the means for attaching is an integrally formed outwardly extending hook eyelet having an opening.

12. The device of claim 11 wherein the hook eyelet is positioned between the first and second slots.

13. The device of claim 8 wherein the connecting member has first and second outwardly extending arm sections and the means for attaching includes first and second spaced apart integrally formed hook eyelets and having a second wire member, each hook eyelet having an opening for receiving the hook portion of the first and second wire members, respectively.

14. The device of claim 8 wherein the object is a plate having a pair of spaced-apart apertures and the first and second outwardly extending leg portions of the wire member include first and second substantially vertically disposed finger portions at their outer ends, respectively, for insertion into the first and second apertures in the plate, all respectively.

15. The device of claim 8 wherein the object to be displayed has an attaching block and means for adhesively attaching the attaching block to the object to be displayed, and wherein the first and second apertures are disposed in the attaching block for receiving the distal end portions of the wire member.

16. The device of claim 8 wherein the support pole-engaging member includes first and second slots positioned in the first and second legs, respectively, proximate the tab portions for cooperation with the first and second slots of the connecting member.

17. The device of claim 8 wherein at least one-half of the inner surface of the pole-engaging member frictionally engages the outer surface of the pole.

18. The device of claim 8 wherein approximately one-half of the inner surface conforms to the outer surface of the pole.

* * * * *